United States Patent [19]

Nakamura et al.

[11] Patent Number: 4,514,157

[45] Date of Patent: Apr. 30, 1985

[54] ROTARY VANE COMPRESSOR

[75] Inventors: Teruo Nakamura; Shoichi Fukuda, both of Konan, Japan

[73] Assignee: Diesel Kiki Company, Ltd., Tokyo, Japan

[21] Appl. No.: 613,996

[22] Filed: May 25, 1984

[30] Foreign Application Priority Data

Jun. 3, 1983 [JP] Japan ..... 58-84985[U]

[51] Int. Cl.[3] ..... F04C 18/00

[52] U.S. Cl. ..... 418/259; 418/270

[58] Field of Search ..... 418/259, 266–270, 418/75, 78, 15, 260–265

[56] References Cited

U.S. PATENT DOCUMENTS 3,025,802 3/1962 Browne ..... 418/82

4,468,180 8/1984 Shibuya ..... 418/15

*Primary Examiner*—Leonard E. Smith

*Assistant Examiner*—Jane E. Obee

*Attorney, Agent, or Firm*—David G. Alexander

[57] ABSTRACT

A rotary vane compressor directed to increasing the gas charging efficiency is disclosed. A side block is formed with an opening which is extended such that radially outer part of its rim is located radially outwardly of the inner periphery of a cylinder. The inner periphery of the cylinder is partly removed to form a notch such that the notch is aligned with the outer part of the rim of the opening. The opening and the notch define a suction port in combination, that is, the available area of opening of the suction port is increased by the proportion of the notch. Gas is sucked into the compressor not only sidewise but also in the peripheral direction.

1 Claim, 3 Drawing Figures

ROTARY VANE COMPRESSOR

BACKGROUND OF THE INVENTION

The present invention relates to a rotary vane compressor and, more particularly, to an improvement in the structure of suction port of such a compressor through which desired gas is sucked into a compression chamber.

As well known in the art, a rotary vane compressor comprises a casing made up of a cylinder and side blocks which are securely mounted on opposite ends of the cylinder. A rotor is disposed in the casing and formed with a plurality of substantially radially extending slots, or grooves, in which vanes are slidably nested. The casing, rotor and vane or vanes define a compression chamber whose volume is sequentially changed as the rotor and vanes are rotated. With the changing volume, the compression chamber sucks gas thereinto via a suction port and compresses the gas to feed it out forcing a delivery valve to open.

Concerning the structure, suction ports of rotary vane compressors heretofore proposed may generally be classified into two types, i.e., a sidewise type port which is formed through a side block to introduce gas sidewise into a compression chamber (e.g. Japanese Utility Model Laid-Open Publication No. 55-106392/1980), and a peripheral type port formed through a cylinder to introduce gas into a compression chamber in the peripheral direction (e.g. Japanese utility Model Laid-Open Publication No. 57-153792/1982). The sidewise type port has a charging efficiency which is high in a low speed range although low in a high speed range because no effect of inertia is available. The sidewise type port with such a characteristic is generally accepted more advantageous than the peripheral type for an automotive air conditioning system or the like which requires a high charging efficiency in a low speed range. To attain an additional charging efficiency with the side type suction port, the sectional area of the port opening into a compression chamber may be increased.

However, it is impossible to increase the sectional area of the sidewise type port and, therefore, the charging eficiency attainable with the sidewise type port beyond a certain limit. The width of the suction port available in the circumferential direction is limited by the positions of vanes. Where a suction port is formed simply by drilling a side block as in the prior art sidewise type port, the radial width of the port is limited by the configuration of the space between a cylinder and a rotor.

SUMMARY OF THE INVENTION

It is therefore an object of the present invention to provide a rotary vane compressor which is capable of increasing a gas charging efficiency.

It is another object of the present invention to provide a rotary vane compressor which is capable of sucking gas not only sidewise but also in the peripheral direction.

It is another object of the present invention to provide a rotary vane compressor which is capable of lowering the temperature of gas delivered from the compressor.

It is another object of the present invention to provide a generally improved rotary vane compressor.

A rotary vane compressor of the present invention comprises a cylinder having a bore and a delivery port formed therein, a pair of side blocks for closing respectively opposite open ends of he cylinder, a rotor rotatably disposed in the bore of the cylinder and formed with a plurality of substantially radially extending slots, a plurality of vanes slidably received in the slots in one-to-one correspondence and individually engaged with an inner periphery of the bore of the cylinder, a compression chamber defined by the cylinder, the rotor and any of the vanes, and an opening formed through one of the side blocks and extended such that radially outer part of a rim of the opening is positioned radially outwardly of the inner periphery of the cylinder, and a notch formed in the inner periphery of the cylinder to be aligned with the outer part of the rim of the opening, the opening and the notch defining the suction port in combination

DESCRIPTION OF THE PREFERRED EMBODIMENT

While the rotary vane pump of the present invention is susceptible of numerous physical embodiments, depending upon the environment and requirements of use, a substantial number of the herein shown and described embodiment have been made, tested and used, and all have performed in an eminently satisfactory manner.

Figure 1:
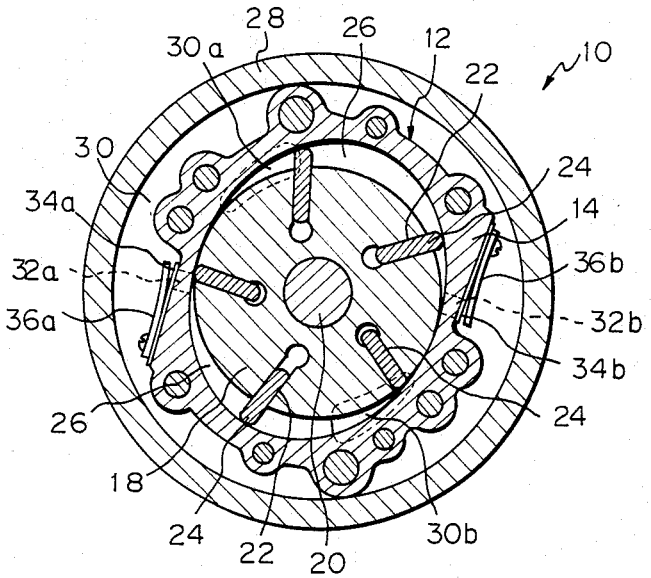
FIG. 1 is a section of a rotary vane compressor embodying the present invention.
Figure 2:
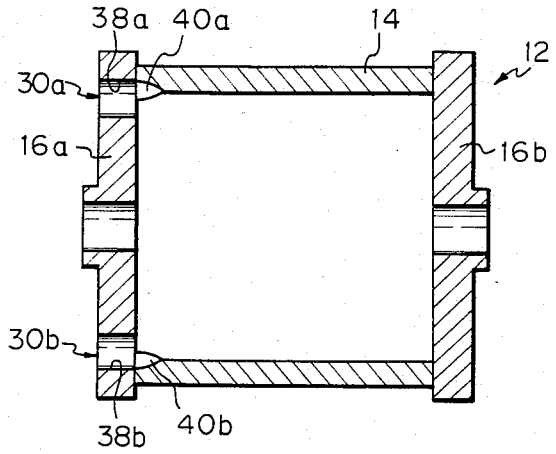
FIG. 2 is a section of a casing of the compressor shown in FIG. 1.
Figure 3:
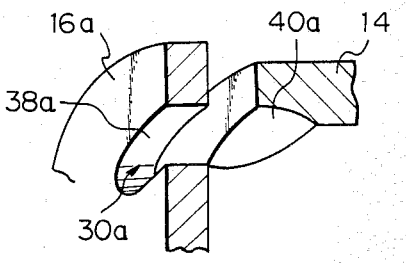
FIG. 3 is a sectional perspective view of a portion of the compressor shown in FIG. 1 which forms a suction port.

Referring to FIGS. 1–3, a rotary vane compressor in accordance with the present invention is shown and generally designated by the reference numeral 10. The compressor 10 has a casing 12 which is made up of a cylinder 14 having a generally oval bore formed therein, and side blocks 16*a* and 16*b* which are fixedly mounted respectively on opposite ends of the cylinder 14. A rotor 18 is disposed in the bore of the casing 12. A drive shaft 20 is rigidly connected with the center of the rotor 18. Opposite ends of the rotor 18 respectively adjoin the side blocks 16*a* and 16*b* each with a small clearance, while part of the cylindrical surface of the rotor 13 adjoins a shorter diameter portion of the oval cylinder 14 also with a small clearance. The drive shaft 20 is rotatably supported by one of the side blocks 16*a* and 16*b*.

The rotor 18 is formed a plurality of slots, such as five slots 22, each extending substantially in the radial direction of the rotor 18. Vanes 24 are slidably received in the slots 22, respectively. Each vane 24 is urged radially outwardly by a centrifugal force developed by the rotation of the rotor 18 and a hydraulic fluid pressure developed by lubricant, which is supplied to the radially innermost end of the slot 22 associated with the vane 22. While the rotor 18 rotates, the radially outermost end of the so urged vane 24 is rotated guided by the inner periphery of the cylinder 14, so that the volume of a compression chamber 26 defined by the vane 14, casing 12 and rotor 18 is changed.

The cylinder 14 is surrounded by a shell 28. The shell 28 cooperates with the casing 12 to define a high pressure chamber 30 therebetween. Meanwhile, one of the side blocks 16*a* and 16*b* delimits a low pressure chamber (not shown) which is partitioned from the high pressure chamber 30. The casing 12 and the low pressure chamber are intercommunicated by suction ports 30*a* and 30*b* which will be described. The cylinder 14 is formed with delivery ports 32*a* and 32*b* therethroughout which individually open into the high pressure chamber 30. A delivery valve 34*a* and a stop 36*a* are located at the outside of the delivery port 32*a* and, likewise, a delivery valve 34*b* and a stop 36*b* are located at the outside of the delivery port 32*b*.

The suction ports 30*a* and 30*b* are respectively defined by openings 38*a* and 38*b* which are formed through one of the side blocks 16*a* and 16*b*, and notches 40*a* and 40*b* which are formed in the cylinder 14 in correspondence with the openings 38*a* and 38*b*. Radially outer part of the rim of each opening 38*a* or 38*b* is radially outwardly extended beyond the inner periphery of the cylinder 14, while the notch 40*a* or 40*b* associated with the opening 38*a* or 38*b* is formed by partly removing the inner periphery of the cylinder in such a manner as to align the notch with the outer part of the rim of the opening. In this construction, each suction port 30*a* or 30*b* opens into the casing 12 over an area which is the sum of the area of the opening 38*a* or 38*b* and the area of the notch 40*a* or 40*b* associated therewith. In the circumferential direction, each suction port 30*a* or 30*b* starts substantially at a position where the inner periphery of the cylinder 14 and the outer periphery of the rotor 18 separates from each other, and terminates at a position of one vane 24 which will be located behind another with respect to an intended direction of rotation of the rotor 18 when the volume of the compression chamber 26 defined by the two vanes 24 becomes maximum (hereinafter referred to as "maximum volume delimiting position" for simplicity). If desired, taking into account such an occurrence that the gas sucked into the compression chamber 26 flows backward due to a reactive force developed therein, the terminating point mentioned may be designed to slightly exceed (less than 10 degrees) the maximum volume delimiting position.

In operation, as the drive shaft 20 is rotated by a torque transmitted thereto from a drive source (not shown), it in turn rotates the rotor 18 integrally therewith so that the outermost ends of the vanes 24 move along the inner periphery of the cylinder 14. A compression chamber 26 starts to increase its volume when any one of the vanes 24 has moved past the adjoining or sealing part of the surfaces of the cylinder 14 and rotor 18. As soon as that vane 24 advances past one end of the suction port 30*a* or 30*b*, the compressor begins to suck gas into the compression chamber 26. This suction stroke continues until the next vane 24 moves past the other end of the suction port 30*a* or 30*b* associated with the preceding vane 24. In this instance, due to the wide opening area of the suction port 30*a* or 30*b*, the compression chamber 26 is filled with a quantity of gas as substantially theoretically expected. This insures an excellent charging efficiency. The compression chamber 26 gradually contracts to compress the gas therein and such a compression stroke terminates when the preceding vane 24 moves past the delivery port 32*a* or 32*b*. Upon arrival of the preceding vane 24 at the delivery port 32*a* or 32*b*, the pressure inside the compression chamber 26 forces the delivery valve 34*a* or 34*b* to open. The delivery stroke lasts until the next vane travels past the delivery port 32*a* or 32*b*.

Assuming that the sucked gas is at a temperature Ts and a pressure Ps, the delivered gas is at a temperature Pd, and the adiabatic compression index is k, there holds an equation:

$$Td = Ts.\ (Pd/Ps)\ \exp\ (k/k-1)$$

It will be seen from the above equation that a higher charging efficiency makes the result of Pd/Ps smaller and, thereby, lowers the temperature Td of the delivered gas.

In summary, it will be seen that the present invention provides a rotary vane pump which features an enhanced performance due to the increase in the available area of suction ports and, therefore, the increase in charging efficiency. This advantage is derived from the inherent construction wherein each suction port is defined by an opening formed through a side block and a notch formed in a cylinder. The increased charging efficiency is also reflected by the drop of the temperature of delivered gas. Meanwhile, since the rim of the suction port is formed smoothly by the associated notch, a minimum of turbulance is allowed to occur in the stream of the gas through the suction port so that oil entrained by the gas can advance deep into the cylinder, thereby enhancing lubrication for vanes. Furthermore, since the increase in the area of the suction port is achievable without changing the width thereof in the circumferential direction, it is needless to change the positions of the vanes and, for this reason, the present invention is readily applicable even to conventional rotary vane pumps.

Various modifications will become possible for those skilled in the art after receiving the teachings of the present disclosure without departing from the scope thereof.

What is claimed is:

1. A rotary vane compressor comprising:

a cylinder having a bore and a delivery port formed therein;

a pair of side blocks for closing respectively opposite open ends of said cylinder;

a rotor rotatably disposed in said bore of the cylinder and formed with a plurality of substantially radially extending slots;

a plurality of vanes slidably received in said slots in one-to-one correspondence and individually engaged with an inner periphery of said bore of the cylinder;

a compression chamber defined by the cylinder, the rotor and any of the vanes; and an opening formed through one of the side blocks and extended such that radially outer part of a rim of said opening is positioned radially outwardly of the inner periphery of the cylinder, and a notch formed in the inner periphery of the cylinder to be aligned with said outer part of the rim of said opening, said opening and said notch defining the suction port in combination.

* * * * *